US006241750B1

(12) United States Patent
Moultrie

(10) Patent No.: US 6,241,750 B1
(45) Date of Patent: Jun. 5, 2001

(54) RETRACTABLE TETHER PACIFIER DEVICE

(76) Inventor: Anita Moultrie, 140 N. Hillcrest Ave., Inglewood, CA (US) 90301

( * ) Notice: Subject to any disclaimer, the term of this patent is extended or adjusted under 35 U.S.C. 154(b) by 0 days.

(21) Appl. No.: 09/226,251

(22) Filed: Jan. 7, 1999

(51) Int. Cl.[7] ..... A61J 17/00
(52) U.S. Cl. ..... 606/234; 606/236
(58) Field of Search ..... 606/234, 235, 606/236; 434/262; 248/104; 119/109, 796; 441/75

(56) References Cited

U.S. PATENT DOCUMENTS 2,595,462 * 5/1952 Johnson ..... 606/234
4,977,860 * 12/1990 Harwell ..... 119/109
4,990,157 * 2/1991 Roberts et al. ..... 606/234
5,082,220 * 1/1992 Pollack et al. ..... 248/104
5,096,424 * 3/1992 Carlberg ..... 434/262
5,948,003 * 9/1999 Shefflin ..... 606/236

* cited by examiner

*Primary Examiner*—David O. Reip

(57) ABSTRACT

A retractable tether pacifier device for holding a pacifier to a user when not in use. The device includes a housing with a slot providing an opening into the interior space of the housing. The first end of an elongate flexible ribbon is disposed in the interior space of the housing with the flexible ribbon extending through the slot of the side wall of the housing such that a second end of the flexible ribbon outwardly extends from the side wall of the housing. The second end of the flexible ribbon is attached to a holding ring of a pacifier. The length of the flexible ribbon is retractably extendable from the interior space of the housing. The back face of the housing has a fastener for attaching the housing to a garment of the user.

18 Claims, 2 Drawing Sheets

RETRACTABLE TETHER PACIFIER DEVICE

BACKGROUND OF THE INVENTION

1. Field of the Invention

The present invention relates to pacifier devices and more particularly pertains to a new retractable tether pacifier device for holding a pacifier to a user when not in use.

2. Description of the Prior Art

The use of pacifier devices is known in the prior art. More specifically, pacifier devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art pacifier devices include U.S. Pat. No. 5,150,504; U.S. Pat. No. 4,903,698; U.S. Pat. No. Des. 274,379; U.S. Pat. No. 4,165,713; U.S. Pat. No. 4,902,261; and U.S. Pat. No. 3,392,729.

While these devices fulfill their respective, particular objectives and requirements, the aforementioned patents do not disclose a new retractable tether pacifier device. The inventive device includes a housing with a slot providing an opening into the interior space of the housing. The first end of an elongate flexible ribbon is disposed in the interior space of the housing with the flexible ribbon extending through the slot of the side wall of the housing such that a second end of the flexible ribbon outwardly extends from the side wall of the housing. The second end of the flexible ribbon is attached to a holding ring of a pacifier. The length of the flexible ribbon is retractably extendable from the interior space of the housing. The back face of the housing has a fastener for attaching the housing to a garment of the user.

In these respects, the retractable tether pacifier device according to the present invention substantially departs from the conventional concepts and designs of the prior art, and in so doing provides an apparatus primarily developed for the purpose of holding a pacifier to a user when not in use.

SUMMARY OF THE INVENTION

In view of the foregoing disadvantages inherent in the known types of pacifier devices now present in the prior art, the present invention provides a new retractable tether pacifier device construction wherein the same can be utilized for holding a pacifier to a user when not in use.

The general purpose of the present invention, which will be described subsequently in greater detail, is to provide a new retractable tether pacifier device apparatus and method which has any of the advantages of the pacifier devices mentioned heretofore and many novel features that result in a new retractable tether pacifier device which is not anticipated, rendered obvious, suggested, or even implied by any of the prior art pacifier devices, either alone or in any combination thereof.

To attain this, the present invention generally comprises a housing with a slot providing an opening into the interior space of the housing. The first end of an elongate flexible ribbon is disposed in the interior space of the housing with the flexible ribbon extending through the slot of the side wall of the housing such that a second end of the flexible ribbon outwardly extends from the side wall of the housing. The second end of the flexible ribbon is attached to a holding ring of a pacifier. The length of the flexible ribbon is retractably extendable from the interior space of the housing. The back face of the housing has a fastener for attaching the housing to a garment of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable tether pacifier device apparatus and method which has many of the advantages of the pacifier devices mentioned heretofore and many novel features that result in a new retractable tether pacifier device which is not anticipated, rendered obvious, suggested, or even implied by any of the prior art pacifier devices, either alone or in any combination thereof.

It is another object of the present invention to provide a new retractable tether pacifier device which may be easily and efficiently manufactured and marketed.

It is a further object of the present invention to provide a new retractable tether pacifier device which is of a durable and reliable construction.

An even further object of the present invention is to provide a new retractable tether pacifier device which is susceptible of a low cost of manufacture with regard to both materials and labor, and which accordingly is then susceptible of low prices of sale to the consuming public, thereby making such retractable tether pacifier device economically available to the buying public.

Still yet another object of the present invention is to provide a new retractable tether pacifier device which provides in the apparatuses and methods of the prior art some of the advantages thereof, while simultaneously overcoming some of the disadvantages normally associated therewith.

Still another object of the present invention is to provide a new retractable tether pacifier device for holding a pacifier to a user when not in use.

Yet another object of the present invention is to provide a new retractable tether pacifier device which includes a housing with a slot providing an opening into the interior space of the housing. The first end of an elongate flexible ribbon is disposed in the interior space of the housing with the flexible ribbon extending through the slot of the side wall of the housing such that a second end of the flexible ribbon outwardly extends from the side wall of the housing. The second end of the flexible ribbon is attached to a holding ring of a pacifier. The length of the flexible ribbon is retractably extendable from the interior space of the housing. The back face of the housing has a fastener for attaching the housing to a garment of the user.

Still yet another object of the present invention is to provide a new retractable tether pacifier device that retracts the flexible ribbon when not in use so that the ribbon is out of the way and does not get tangled around the user.

Even still another object of the present invention is to provide a new retractable tether pacifier device that helps prevent the pacifier from touching the ground and contacting unwanted germs when not in the mouth of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
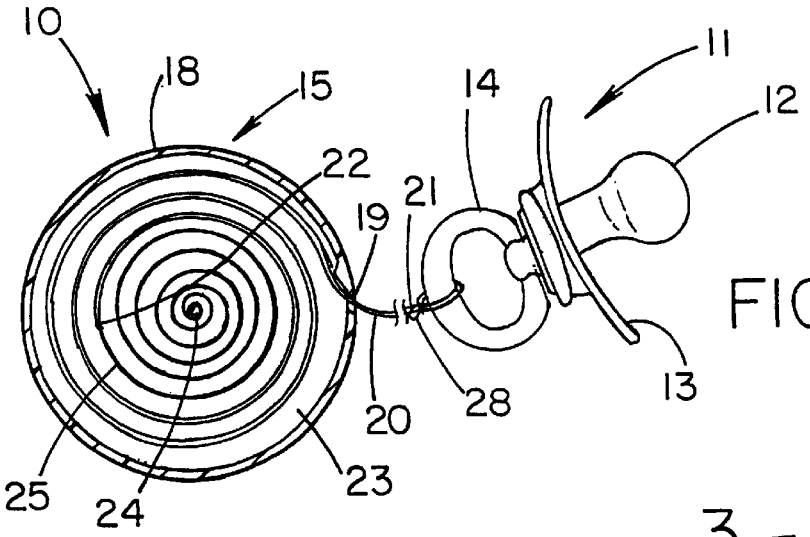
FIG. 2 is a schematic sectional view of the present invention taken from line 2—2 of FIG. 1.
Figure 5:
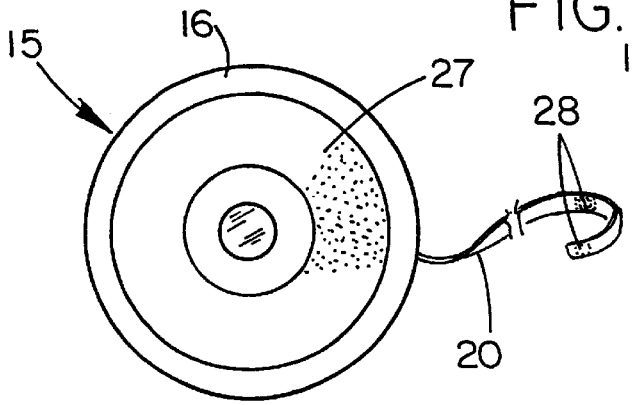
FIG. 5 is a schematic side view of the front face housing of the present invention in use.
Figure 1:
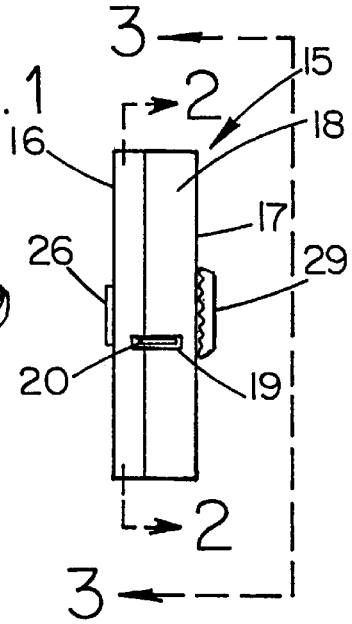
FIG. 1 is a schematic side view of a new retractable tether pacifier device according to the present invention.
Figure 3:
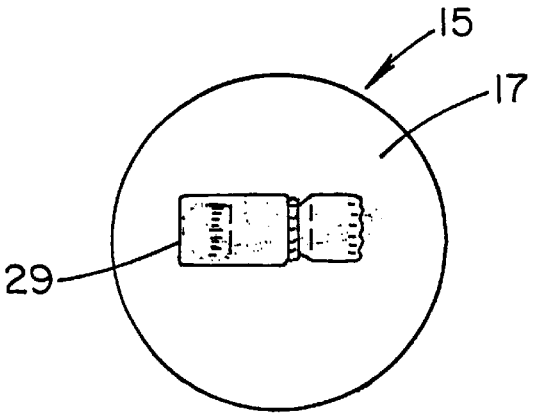
FIG. 3 is a schematic side view of the back face of the present invention as seen from the vantage of line 3—3 of FIG. 1.
Figure 4:
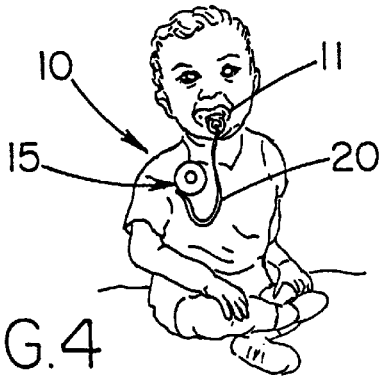
FIG. 4 is a schematic view of the present invention in use.

With reference now to the drawings, and in particular to FIGS. 1 through 7 thereof, a new retractable tether pacifier device embodying the principles and concepts of the present invention and generally designated by the reference numeral 10 will be described.

As best illustrated in FIGS. 1 through 7, the retractable tether pacifier device 10 generally comprises a housing 15 with a slot 19 providing an opening into the interior space 23 of the housing 15. The first end 21 of an elongate flexible ribbon 20 is disposed in the interior space 23 of the housing 15 with the flexible ribbon 20 extending through the slot 19 of the side wall 18 of the housing 15 such that a second end 22 of the flexible ribbon 20 outwardly extends from the side wall 18 of the housing 15. The second end 22 of the flexible ribbon 20 is attached to a holding ring 14 of a pacifier 11. The length of the flexible ribbon 20 is retractably extendable from the interior space 23 of the housing 15. The back face 17 of the housing 15 has a fastener 29 for attaching the housing 15 to a garment of the user.

In closer detail, the pacifier 11 has a nipple portion 12 for insertion into a mouth of a user, a mouth shield 13, and a holding ring 14 pivotally coupled to the mouth shield 13. The retractable tether device comprises a housing 15 and an elongate flexible ribbon 20.

The housing 15 is generally disk-shaped and has an interior space 23, spaced apart generally circular front and back faces 16,17, and a generally cylindrical side wall 18 interposed between the faces of the housing 15. Optionally, the front and back faces 16,17 of the housing 15 may be generally heart shaped. The housing 15 has a center axis extending through the centers the front and back faces 16,17 of the housing 15 so that the front and back faces 16,17 and the side wall 18 of the housing 15 are all coaxial. The side wall 18 of the housing 15 has a generally rectangular slot 19 therethrough providing an opening into the interior space 23 of the housing 15. The length of the slot 19 of the side wall 18 extends between the front and back faces 16,17 of the housing 15 generally parallel to the center axis of the housing 15. The housing 15 has a thickness defined between the front and back faces 16,17 of the housing 15. Preferably, the length of the slot 19 is greater than one-half the thickness of the housing 15. The housing 15 preferably has a diameter greater than 1 inch and ideally about 2½ inches.

The elongate flexible ribbon 20 has opposite first and second ends 21,22 and a length defined between the first and second ends 21,22 of the flexible ribbon 20. The first end 21 of the flexible ribbon 20 is disposed in the interior space 23 of the housing 15 with the flexible ribbon 20 extending through the slot 19 of the side wall 18 of the housing 15 such that the second end 22 of the flexible ribbon 20 outwardly extends from the side wall 18 of the housing 15. The second end 22 of the flexible ribbon 20 is attached to the holding ring 14 of the pacifier 11. Preferably, the second end 22 of the flexible ribbon 20 is looped through the holding ring 14 of the pacifier 11 and attached to an adjacent portion of the flexible ribbon 20 to attach the flexible ribbon 20 to the holding ring 14 of the pacifier 11. Ideally, a hook and loop fastener 28 commonly known as "Velcro" is provided to detachably attach the second end 22 of the flexible ribbon 20 to the adjacent portion of the flexible ribbon 20.

A rod 24 is provided in the interior space 23 of housing 15 with the length of the rod extending between the front and back faces 16,17 of the housing 15 and being coaxial with the center axis of the housing 15. The first end 21 of the flexible ribbon 20 is coupled to the rod 24. The flexible ribbon 20 has a spring portion 25 provided adjacent the first end 21 of the flexible ribbon 20 which is coiled about the rod 24 such that the spring portion 25 biases the flexible ribbon 20 to coil about the rod 24 to retract as much the length of the flexible ribbon 20 as possible into the interior space 23 in a coil about the rod 24. In use, pulling of the second end 22 of the flexible ribbon 20 uncoils a portion of the flexible ribbon 20 and permits extension of the portion of the length of the flexible ribbon 20 outside the exterior of the housing 15.

Preferably, a holding device is provided for selectively holding the flexible ribbon 20 in a position the portion of the flexible ribbon 20 outwardly extending from the slot 19 of the side wall 18 of the housing 15. The holding device selectively prevents the outwardly extended portion of the flexible ribbon 20 from retracting into the interior space 23 of the housing 15 and coiling about the rod 24. The holding device has an actuator 26 provided on the front face 16 of the housing 15 to permit selective holding of the extended portion of the flexible ribbon 20 in a held position. The actuator 26 is preferably positioned at the center of the front face 16 of the housing 15. Ideally, the actuator 26 comprises a push button actuator 26 such that pressing of the push button actuator 26 holds the extended portion of the flexible ribbon 20 in the held position.

The front face 16 of the housing 15 also ideal has a generally circular design region 27 provided thereon. The design region 27 has a center which is centered on the center of the front face 16. The outer perimeter of the design region 27 is spaced apart from the outer perimeter of the front face 16 of the housing 15 such that the outer perimeters of the design region 27 and the front face 16 are generally concentric. Preferably, the design region 27 has a plurality of images provided thereon. Ideally, the design region 27 has a phosphorescent material (i.e., a glow in the dark material) provided thereon.

The back face 17 of the housing 15 has a fastener 29 for attaching the housing 15 to a garment of the user. Ideally, the fastener 29 comprises a spring biases clip such as the type found on the back of name tags.

In use, the housing is attached to the garment of the user with the fastener. The second end of the ribbon is pulled to extend the length of the ribbon from the housing so that the nipple portion of the pacifier may be inserted into the mouth of the user. When the nipple portion of the pacifier is removed from the mouth of the user, the spring portion of the ribbon biases the ribbon to retract into the interior space of the housing and coil about the rod in the interior space of the housing so that the pacifier does not fall on to a ground surface.

Figure 6:
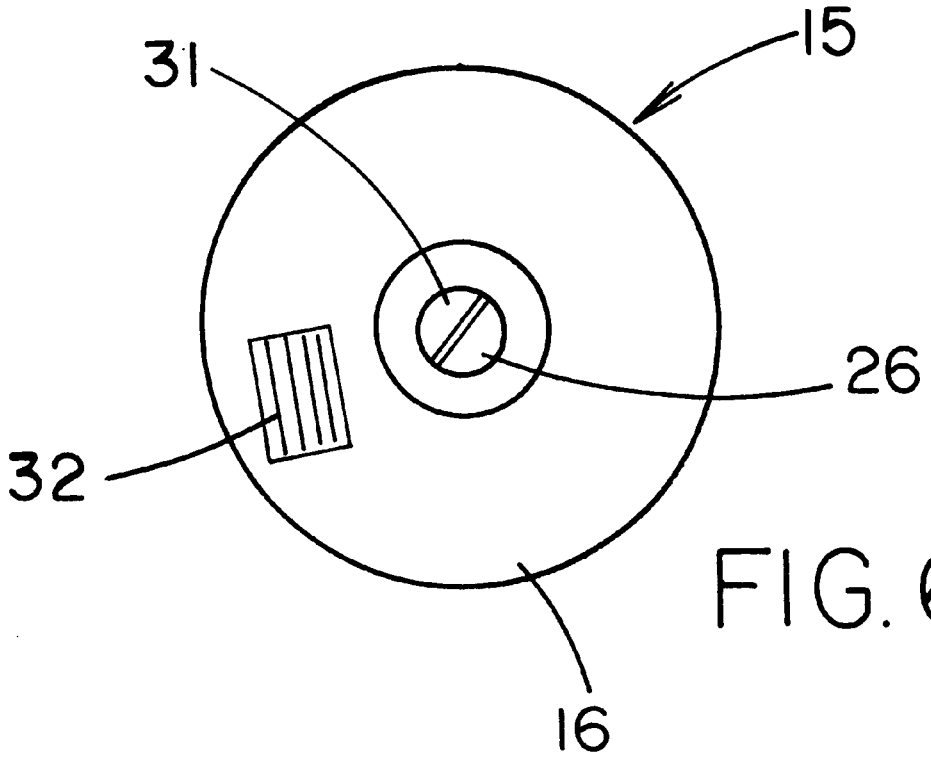
FIG. 6 is a schematic side view of the front face of a sound generating embodiment of the present invention.
Figure 7:
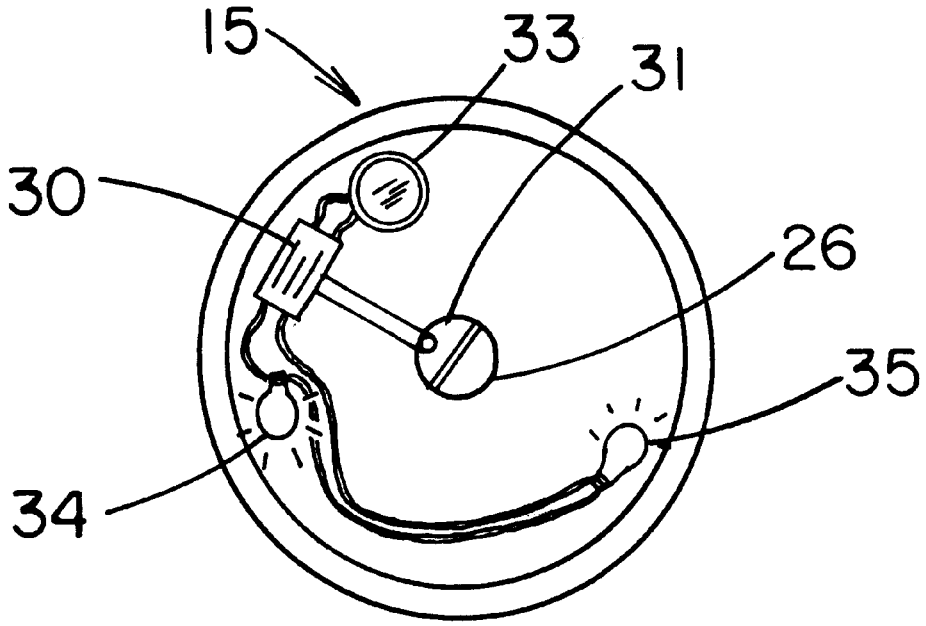
FIG. 7 is a schematic cross sectional view of the sound generating embodiment of the present invention.

FIGS. 6 and 7 illustrate another preferred embodiment of the device. In this embodiment, the holding device has an generally semi-circular actuator 26 provided on the front face of the housing. Also included in this embodiment is a sound generating device 30 provided in the housing for generating an audible sound such as a short melody when activated. The sound generating device has a speaker in the housing for projecting the audible sound generated from the sound generating device. The sound generating device also has a switch for selectively activating the sound generating device. The switch of the sound generating device has a generally semi-circular actuator 31 provided on the front face of the housing adjacent the actuator of the holding device. In use, pressing the actuator of the switch of the sound generating device activates the sound generating device to generate an audible sound. In this embodiment, the front face of the housing preferably has a port 32 therethrough adjacent the sound generating device for permitting passage of sound therethrough.

A battery 33 is also provided in the housing and electrically connected to the sound generating device for powering the sound generating device. A pair of light sources 34,35 (such as LED's) are also provided in the housing and electrically connected to the sound generating device. Ideally, a first of the light sources emits light of a first color such as red light while a second of the light sources emits light of a second color such as green light. In use, the light sources are activated to emit light when the actuator is depressed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device, comprising:

a pacifier having a nipple portion for insertion into a mouth of a user and a holding ring;

a housing having an interior space, spaced apart front and back faces, and a generally side wall interposed between said faces of said housing;

said side wall of said housing having a slot therethrough providing an opening into said interior space of said housing;

an elongate flexible ribbon having opposite first and second ends and a length defined between said first and second ends of said flexible ribbon,.said first end of said flexible ribbon being disposed in said interior space of said housing, said flexible ribbon being extended through said slot of said side wall of said housing such that said second end of said flexible ribbon outwardly extends from said side wall of said housing;

said second end of said flexible ribbon being attached to said holding ring of said pacifier;

said length of said flexible ribbon being retractably extendable from said interior space of said housing through said slot of said side wall, said flexible ribbon being biased towards retracting into said interior space of said housing;

said back face of said housing having a fastener for attaching said housing to a garment of the user; and a sound generating device being provided in said housing for generating an audible sound when activated. said sound generating device having a speaker in said housing for projecting the audible sound generated from said sound generating device.

2. The device of claim 1, said housing is generally disk-shaped and said front and back faces of said housing are generally circular.

3. The device of claim 2, wherein said housing has a diameter of about 2½ inches.

4. The device of claim 1, wherein said housing has a center axis extending between said front and back faces of said housing, and wherein said slot of said side wall has a length extending between said front and back faces of said housing generally parallel to said center axis of said housing.

5. The device of claim 4, wherein said housing has a thickness defined between said front and back faces of said housing, wherein said length of said slot is greater than one-half said thickness of said housing.

6. The device of claim 1, wherein said second end of said flexible ribbon is looped through said holding ring of said pacifier and attached to an adjacent portion of said flexible ribbon to attach said flexible ribbon to said holding ring of said pacifier.

7. The device of claim 6, wherein a hook and loop fastener is provided to detachably attach said second end of said flexible ribbon to said adjacent portion of said flexible ribbon.

8. The device of claim 1, further comprising a rod being provided in said interior space of housing, said rod having a length extending between said front and back faces of said housing, said first end of said flexible ribbon being coupled to said rod, said flexible ribbon having a spring portion provided adjacent said first end of said flexible ribbon, said spring portion being coiled about said rod such that said spring portion biases said flexible ribbon to coil about said rod to retract the length of the flexible ribbon into said interior space in a coil about said rod.

9. The device of claim 8, further comprising a locking device for selectively locking said flexible ribbon in a position wherein a portion of said flexible ribbon outwardly extends from said slot of said side wall of said housing, wherein said locking device selectively prevents the outwardly extended portion of said flexible ribbon from retracting into said interior space of said housing and coiling about said rod.

10. The device of claim 9, wherein said locking device has an actuator provided on said front face of said housing to permit selective locking of said extended portion of said flexible ribbon in a held position.

11. The device of claim 10, wherein said actuator comprises a push button actuator such that pressing of the push button actuator holds said extended portion of said flexiblc ribbon in the held position.

12. The device of claim 1, further comprising a pair of light sources being provided in said housing and electrically connected to said sound generating device.

13. The device of claim 12, wherein the light sources are activated upon activation of the sound generating device.

14. The device of claim 1, wherein said sound generating device has a switch for selectively activating said sound generating device, said switch of said sound generating device having a generally semi-circular actuator providing on said front face of said housing adjacent said actuator of said holding device.

15. The device of claim 1, wherein said front face of said housing having a port therethrough adjacent said sound generating device for permitting passage of sound therethrough.

16. The device of claim 1, further comprising a battery being provided in said housing and electrically connected to said sound generating device.

17. A device, comprising:

a pacifier having a nipple portion for insertion into a mouth of a user and a holding ring;

a housing being generally disk-shaped and having an interior space, spaced apart generally circular front and back faces, and a generally cylindrical side wall interposed between said faces of said housing;

said front and back faces of said housing each having a center, said housing having a center axis extending through said centers said front and back faces of said housing;

said side wall of said housing having a generally rectangular slot therethrough providing an opening into said interior space of said housing, said slot of said side wall having a length extending between said front and back faces of said housing generally parallel to said center axis of said housing;

said housing having a thickness defined between said front and back faces of said housing, wherein said length of said slot is greater than one-half said thickness of said housing;

said housing having a diameter, said diameter of said housing being about 2½ inches;

an elongate flexible ribbon having opposite first and second ends and a length defined between said first and second ends of said flexible ribbon, said first end of said flexible ribbon being disposed in said interior space of said housing, said flexible ribbon being extended through said slot of said side wall of said housing such that said second end of said flexible ribbon outwardly extends from said side wall of said housing;

said second end of said flexible ribbon being attached to said holding ring of said pacifier, wherein said second end of said flexible ribbon is looped through said holding ring of said pacifier and attached to an adjacent portion of said flexible ribbon to attach said flexible ribbon to said holding ring of said pacifier, wherein a hook and loop fastener is provided to detachably attach said second end of said flexible ribbon to said adjacent portion of said flexible ribbon;

a rod being provided in said interior space of housing, said rod having a length extending between said front and back faces of said housing, said length of said rod being coaxial with said center axis of said housing;

said first end of said flexible ribbon being coupled to said rod;

said flexible ribbon having a spring portion provided adjacent said first end of said flexible ribbon, said spring portion being coiled about said rod such that said spring portion biases said flexible ribbon to coil about said rod to retract the length of the flexible ribbon into said interior space in a coil about said rod;

a locking device for selectively locking said flexible ribbon in a position wherein the portion of said flexible ribbon outwardly extends from said slot of said side wall of said housing, said locking device selectively preventing the outwardly extended portion of said flexible ribbon from retracting into said interior space of said housing and coiling about said rod;

said locking device having an actuator provided on said front face of said housing to permit selective holding of said extended portion of said flexible ribbon in a held position, said actuator being positioned at said center of said front face of said housing, wherein said actuator comprises a push button actuator such that pressing of the push button actuator locks said extended portion of said flexible ribbon in the held position;

said front face of said housing having a generally circular design region provided thereon, said front face of said housing having an outer perimeter;

said design region having a center and an outer perimeter, said center of said design region being centered on said center of said front face, said outer perimeter of said design region being spaced apart from said outer perimeter of said front face of said housing such that said outer perimeters of said design region and said front face are generally concentric;

wherein said design region has a plurality of images provided thereon, wherein said design region has a phosphorescent material provided thereon; and said back face of said housing having a fastener for attaching said housing to a garment of the user, wherein said fastener comprises a spring biases clip.

18. A device, comprising:

a pacifier having a nipple portion for insertion into a mouth of a user and a holding ring;

a housing being generally disk-shaped and having an interior space, spaced apart generally circular front and back faces, and a generally cylindrical side wall interposed between said faces of said housing;

said front and back faces of said housing each having a center, said housing having a center axis extending through said centers said front and back faces of said housing;

said side wall of said housing having a generally rectangular slot therethrough providing an opening into said interior space of said housing, said slot of said side wall having a length extending between said front and back faces of said housing generally parallel to said center axis of said housing;

said housing having a thickness defined between said front and back faces of said housing, wherein said length of said slot is greater than one-half said thickness of said housing;

said housing having a diameter, said diameter of said housing being about 2½ inches;

an elongate flexible ribbon having opposite first and second ends and a length defined between said first and second ends of said flexible ribbon, said first end of said flexible ribbon being disposed in said interior space of said housing, said flexible ribbon being extended through said slot of said side wall of said housing such that said second end of said flexible ribbon outwardly extends from said side wall of said housing;

said second end of said flexible ribbon being attached to said holding ring of said pacifier, wherein said second end of said flexible ribbon is looped through said holding ring of said pacifier and attached to an adjacent portion of said flexible ribbon to attach said flexible ribbon to said holding ring of said pacifier, wherein a hook and loop fastener is provided to detachably attach said second end of said flexible ribbon to said adjacent portion of said flexible ribbon;

a rod being provided in said interior space of housing, said rod having a length extending between said front and back faces of said housing, said length of said rod being coaxial with said center axis of said housing;

said first end of said flexible ribbon being coupled to said rod;

said flexible ribbon having a spring portion provided adjacent said first end of said flexible ribbon, said spring portion being coiled about said rod such that said spring portion biases said flexible ribbon to coil about said rod to retract the length of the flexible ribbon into said interior space in a coil about said rod;

a holding device for selectively holding said flexible ribbon in a position the portion of said flexible ribbon outwardly extending from said slot of said side wall of said housing, said holding device selectively preventing the outwardly extended portion of said flexible ribbon from retracting into said interior space of said housing and coiling about said rod;

said holding device having an generally semi-circular actuator provided on said front face of said housing to permit selective holding of said extended portion of said flexible ribbon in a held position, said actuator being positioned at said center of said front face of said housing, wherein said actuator comprises a push button actuator such that pressing of the push button actuator holds said extended portion of said flexible ribbon in the held position;

said front face of said housing having a generally circular design region provided thereon, said front face of said housing having an outer perimeter;

said design region having a center and an outer perimeter, said center of said design region being centered on said center of said front face, said outer perimeter of said design region being spaced apart from said outer perimeter of said front face of said housing such that said outer perimeters of said design region and said front face are generally concentric;

wherein said design region has a plurality of images provided thereon, wherein said design region has a phosphorescent material provided thereon;

said back face of said housing having a fastener for attaching said housing to a garment of the user, wherein said fastener comprises a spring biases clip;

a sound generating device being provided in said housing for generating an audible sound when activated, said sound generating device having a speaker in said housing for projecting the audible sound generated from said sound generating device;

said sound generating device having a switch for selectively activating said sound generating device, said switch of said sound generating device having a generally semicircular actuator providing on said front face of said housing adjacent said actuator of said holding device;

said front face of said housing having a port therethrough adjacent said sound generating device for permitting passage of sound therethrough;

a battery being provided in said housing and electrically connected to said sound generating device;

a pair of, light sources such as LED's being provided in said housing and electrically connected to said sound generating device such that the light sources are activated upon activation of the sound generating device.

* * * * *